US005588525A

United States Patent [19]

Rosler

[11] Patent Number: 5,588,525

[45] Date of Patent: Dec. 31, 1996

[54] CONTAINER FOR ANNULAR WORKPIECE

[75] Inventor: Peter Rosler, Wangen, Germany

[73] Assignee: Rose-Plastic GmbH, Hergensweiler, Germany

[21] Appl. No.: 598,458

[22] Filed: Feb. 8, 1996

[30] Foreign Application Priority Data

Feb. 13, 1995 [DE] Germany ..... 295 02 288.4

[51] Int. Cl.[6] ..... B65D 85/02

[52] U.S. Cl. ..... 206/303; 206/319; 206/338; 220/400

[58] Field of Search ..... 206/303, 307, 206/307.1, 394, 391, 319, 493, 499, 338, 340; 220/400, 408, 671

[56] References Cited

U.S. PATENT DOCUMENTS 657,250 9/1900 Pratt ..... 206/303

3,978,761 9/1976 Sosinski ..... 206/338

5,366,084 11/1994 Post ..... 206/319

*Primary Examiner*—Paul T. Sewell

*Assistant Examiner*—Shian T. Lam

*Attorney, Agent, or Firm*—Anderson, Kill, Olick P.C.

[57] ABSTRACT

A container for storing annular workpieces having a slot across a circumference thereof includes an inner core part having a first length section formed as a smooth cylindrical body having a rib extending parallel to a container axis substantially along an entire longitudinal extent of the first section for engagement in slots of the annular workpieces, and a second length section adjoining the first length section and formed as a substantially cylindrical body having a diameter larger than a diameter of the smooth cylindrical body forming the first section, and an outer jacket part having an inner circumferential surface spaced from an outer circumferential surface of the smooth cylindrical body and adjoining an outer circumferential surface of the cylindrical body forming the second section.

12 Claims, 2 Drawing Sheets

CONTAINER FOR ANNULAR WORKPIECE

BACKGROUND OF THE INVENTION

The present invention relates to a container for storing annular workpieces having a slot across their circumference, such as piston rings. In particular the present invention relates to a container for storing slotted annular members which is formed of two, substantially cylindrical, parts, namely, an inner core part and an outer jacket part that at least partially surrounds the core part.

Annular workpieces are often cut off from a hollow cylinder on an automatic machine tool and later, when used, are mounted on a cylindrical body. This, e.g., is characteristic for piston rings which, after being separately produced, are transported to a location of their use where they are mounted, e.g., on pistons of internal combustion engines. The piston rings are subjected to precise machining and should be reliably protected against any damage during their transportation to a use location. A further requirement consists in insuring automatization of processes of manufacturing and assembly of piston rings to a largest degree possible.

Accordingly, an object of the invention is providing a container for annular workpieces or rings, in particular piston rings, suitable for receiving separate rings as they are being produced on an automatic machine-tool for transporting them to a use location.

Another object of the invention is a container of the above-described type that would insure a reliable protection of the rings and their position during the transportation of the rings to the use location.

A further object of the invention is providing a container for piston rings of the above-described type that would insure an easy removal of separate rings in an automatic process of mounting of the rings on cylindrical bodies.

SUMMARY OF THE INVENTION

These and other objects of the present invention, which will become apparent hereinafter, are achieved by providing a container of the above-described type, in which the inner core part has a first length section formed as a smooth cylindrical body having a rib extending parallel to a container axis substantially along an entire longitudinal extent of the first section for engagement in slots of the stored annular workpieces, and a second length section adjoining the first length section and formed as a substantially cylindrical body having a diameter larger than a diameter of the smooth cylindrical body forming the first section, and an outer jacket part having an inner circumferential surface spaced from an outer circumferential surface of the smooth cylindrical body forming the first section, and adjoining an outer circumferential surface of the cylindrical body forming the second section.

In the container according to the present invention, a plurality of rings can be supported on the inner core part, with the rib provided on the outer circumference of the first length section of the inner core part engaging in ring slots. This insures a predetermined circumferential position of the rings on the core part, with the rings being protected from any damage by the outer jacket part.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENT

The container according to the present invention and shown in drawings, is formed of two substantially cylindrical parts, namely, an inner core part 1 and an outer jacket part 2 which at least partially surrounds the inner core part 1. The inner core part 1 is designed for receiving and retaining a plurality of annular workpieces or rings 3 which have a slot 4 across their circumference.

Figure 1:
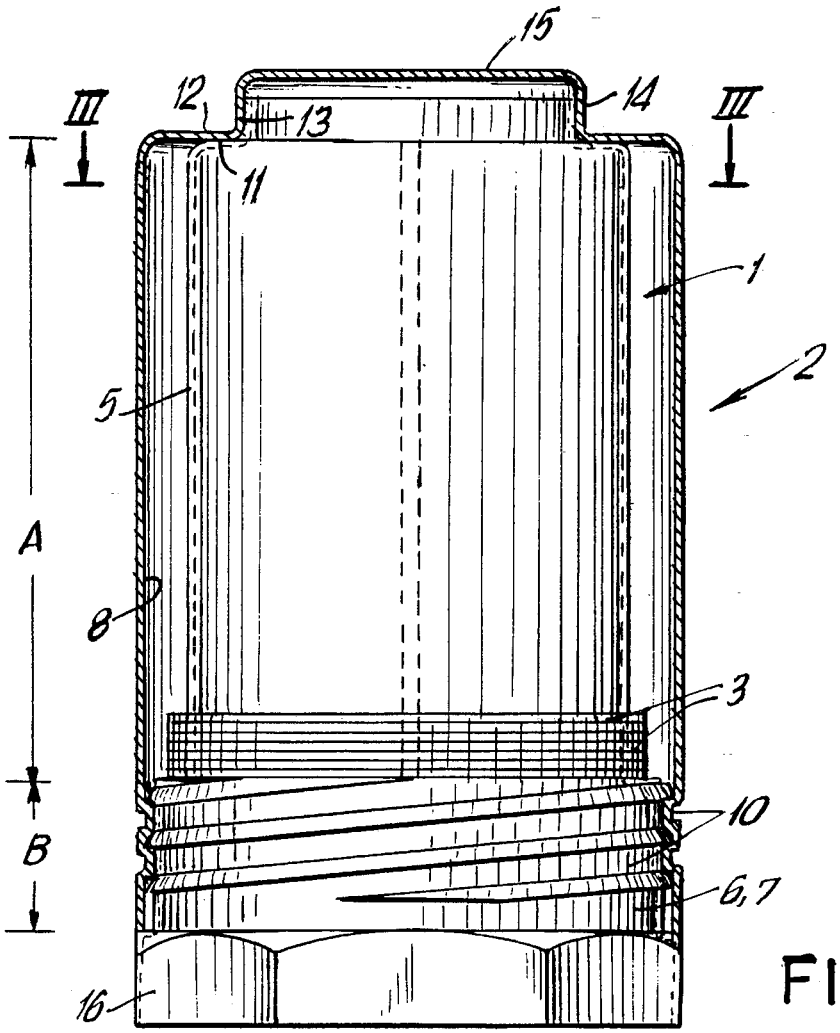
FIG. 1 shows an elevational view of the inner core part and an elevational cross-sectional view of the outer jacket part of the container according to the present invention.
Figure 3:
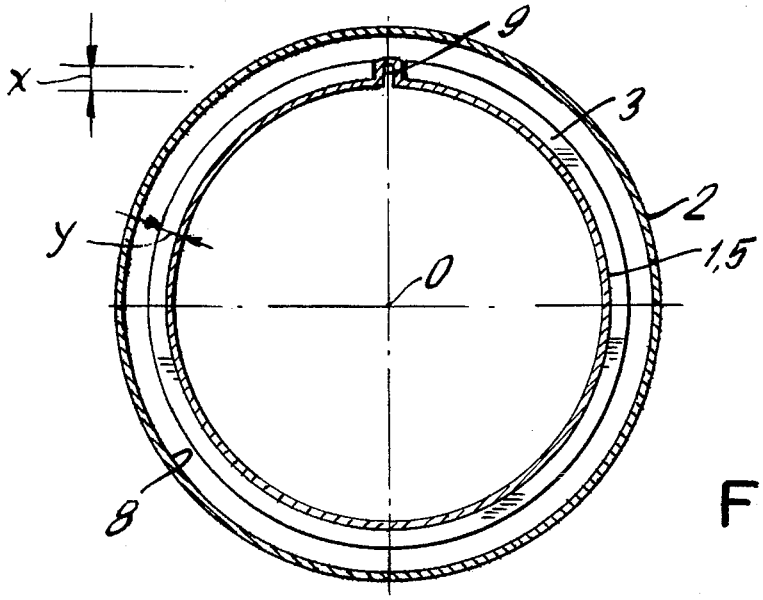
FIG. 3 shows a cross-sectional view along line III—III in FIG. 1.
Figure 2:
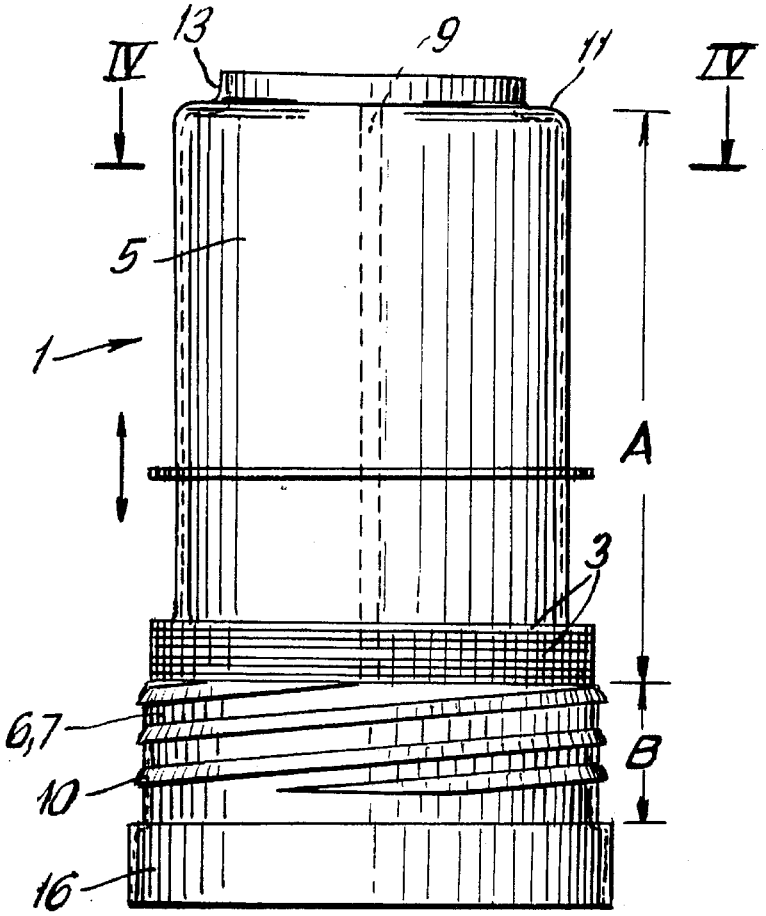
FIG. 2 shows an elevational view of the inner core part alone.

The inner core part has, along its longitudinal extent, a first section A formed as a smooth-wall cylinder body 5, and a second section B likewise formed as a cylinder body 6 but having a larger diameter than the cylinder body 5. The outer circumference 7 of the cylinder body 6 and the inner circumferential surface 8 of the outer jacket part 2 adjoin each other. As can be seen in FIG. 1, the inner circumferential surface 8 is spaced from the outer circumference of the cylinder body 5.

The outer surface of the cylinder body 5 has, along the entire longitudinal extent of the Section A a rib 9 extending parallel to the longitudinal axis O of the container. The rib 9 engages in the slots 4 of rings 3 when the rings 3 are stored in or carried by the container.

Preferably, a mesh connection is provided between the outer circumferential surface 7 of the core part 1 and the inner circumferential surface 8 of the jacket part 2 in the region of the section B of the core part 1. Advantageously, the mesh connection is formed as a threaded connection 10, in particular as a coarse or trapezoidal thread. Such a thread enables an axial displacement of the jacket part 2 over the thread webs, which facilitate the automatization of the packaging process, i.e., placing the jacket part 2 on the Section B of the inner core part 1. However, the mesh connection can also be formed as a bayonet connection with which the connection is obtained by, first, axially displacing and then rotating the jacket part.

The inner core part 1 and the outer jacket part 2 have, preferably at their ends remote from the section B annular surfaces 11 and 12, respectively, which extend at a right angle to the container axis and abut each other. A pressure force, acting parallel to the container longitudinal axis 0, is applied to the abutting surfaces 11 and 12 as a result of the mesh or thread connection of the two parts. The core part 1 and the jacket part 2 are, preferably, provided, respectively, with annular collars 13 and 14 extending parallel to the container longitudinal axis. The collars 13 and 14 project from the annular surfaces 11 and 12, respectively, and adjoin each other. The adjoining or abutting surfaces 11–14 insure the stability of the container which is very important, when the weight of the carried rings 3 is taken into account. Advantageously, at least the annular collar 14 of the jacket part 2 passes into a closed surface 15, which extends transverse to the longitudinal axis O of the container. The surface 15 forms the cover of the container.

Figure 4:
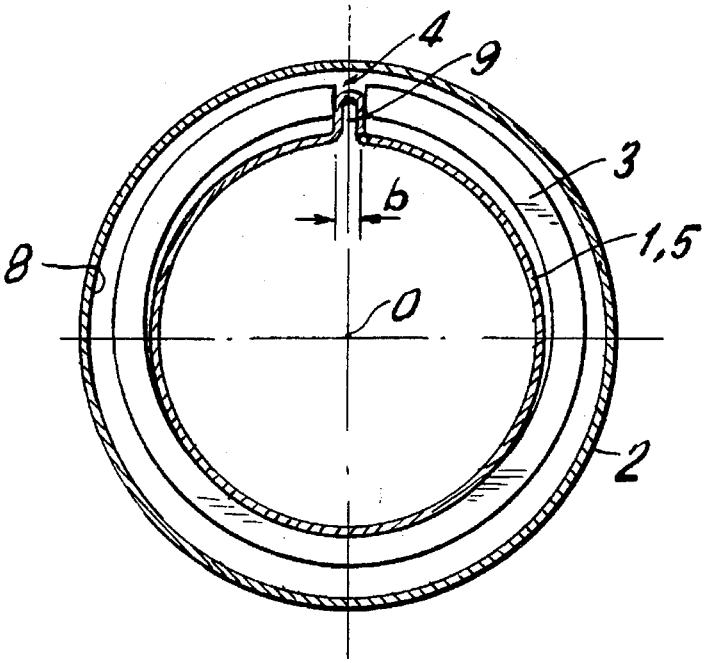
FIG. 4 shows a cross-sectional view along line IV—IV in FIG. 2, with a similar view of the outer jacket part being added.

The outer diameter of the cylinder body 5 of the first Section A is preferably selected to be equal to the inner diameter of the received annular workpieces or rings 3, so that the latter are snugly supported on the cylinder body 5, with the rib 9 being engaged in slots 4 of rings 3. The rib 9 extends out from the outer circumferential surface of the core part 1 by a distance X which should be at least equal to the cross-sectional width Y of the rings 3. However, sometimes a slight difference between the outer diameter of the cylinder body 5 and the inner diameter of the rings 3 is allowed so that the expenditure of adapting of the core part 1 for snug reception of the rings 3 would not be inadmissibly high. According to the invention, it is contemplated that the dimension X, defining the projection of the rib 9 from the outer circumferential surface of the core part 1, can be larger than the width Y of the rings 3, with the width of the rib 9 being likewise somewhat larger than the width b of the slot 4. In this case, the ring 3 is supported on the inner core part with some clearance, as shown in FIG. 4. However, the ring still applies a locking pressure on the rib 9, so that the position of the ring during transportation is insured. However, the width of the rib 9 can be increased by using an additional element, so that a similarly dimensioned inner core part and outer jacket part can be used for rings having dimensions varying within a small limited range.

The second section B of the inner core part 1 has, preferably, at an end thereof, an end flange 16, the outer circumferential surface of which has a larger diameter than the cylinder body 6 and has a shape suitable for being received in a holding device. For example, the end flange may have a shape, as shown in FIG. 1, of the hexagon. In addition, the end flange 16 can have a wall thickness larger than that of the Section B. For example, the wall thickness of the end flange 16 can coincide with the inner circumferential surface of the cylinder body 6, whereas the core part 1 advantageously is made as a hollow body open at an end thereof remote from the Section A.

According to the invention, there is provided a container an inner core part of which can be supported on a mandrel and/or the end flange of which can be retained by a holding device, e.g., in alignment with and opposite to a machine-tool for manufacturing separate rings 3. The finished separate rings 3 are transferred from the machine-tool onto the inner core part 1 one after another until a predetermined number of rings 3 is received thereon or until the last ring is located adjacent to the transverse surface 11 of the core part 1. Then, the jacket part 2 is pushed onto the core part 1 until a mesh connection takes place. Thereafter, the end flange 16 of the container is released, and the container is transported to a use location. There, the process is effected in a reverse order, with the jacket part 2 being taken off and the rings 3 being transferred onto cylindrical bodies aligned with the core part, e.g. being pushed onto pistons of internal combustion engines.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A container for storing annular workpieces having a slot across a circumference thereof, said container comprising:

an inner core part having a first length section formed as a smooth cylindrical body having a rib extending parallel to a container axis substantially along an entire longitudinal extent of the first section for engagement in slots of the stored annular workpieces, and a second length section adjoining the first length section and formed as a substantially cylindrical body having a diameter larger than a diameter of the smooth cylindrical body forming the first section; and an outer jacket part having an inner circumferential surface spaced from an outer circumferential surface of the smooth cylindrical body forming the first section and adjoining an outer circumferential surface of the cylindrical body forming the second section.

2. A container as set forth in claim 1, wherein a mesh connection is formed between the inner circumferential surface of the jacket part and the outer circumferential surface of the cylindrical body forming the second section.

3. A container as set forth in claim 2, wherein the mesh connection is formed as a threaded connection.

4. A container as set forth in claim 2, wherein the mesh connection comprises a bayonet locking connection.

5. A container as set forth in claim 3, wherein the threaded connection comprises one of a coarse thread connection and a trapezoidal thread connection.

6. A container as set forth in claim 1, wherein the inner core part and the outer jacket part have, respectively, at ends thereof remote from the second section, annular surfaces extending substantially at a right angle to the container axis and adjoining each other, the adjoining annular surfaces being subjected to a pressure force acting parallel to the container axis and resulting from establishing a mesh connection between the inner core part and the outer jacket part.

7. A container as set forth in claim 6, wherein the inner core part and the outer jacket part have, respectively, annular collars projecting from respective annular surfaces, extending parallel to the container axis, and adjoining each other, and wherein at least the collar of the outer jacket part has a closed cover surface extending transverse to the container axis.

8. A container as set forth in claim 1, wherein the rib projects from the outer surface of the smooth cylinder body forming the first section by a distance which is at least equal to a cross-sectional width of the to-be-stored rings.

9. A container as set forth in claim 8, wherein the rib has a width, slightly larger than a width of slots of the to-be-stored rings.

10. A container as set forth in claim 1, wherein the second section of the inner core part has at an end thereof remote from the first section an end flange having a diameter larger than a diameter of the second section and a shape suitable to be received in a holding device.

11. A container as set forth in claim 10, wherein the end flange is formed as a hexagon.

12. A container as set forth in claim 1, wherein the inner core part is formed as a hollow body open at an end thereof remote from the first section.

* * * * *